US006619629B1

(12) United States Patent
Boswell

(10) Patent No.: US 6,619,629 B1
(45) Date of Patent: Sep. 16, 2003

(54) GUIDE DEVICE FOR VEHICLE PARKING

(76) Inventor: Anthony Boswell, 1 Stony Hill, Paulersbury, Northants NN12 7PB (GB)

( * ) Notice: Subject to any disclaimer, the term of this patent is extended or adjusted under 35 U.S.C. 154(b) by 0 days.

(21) Appl. No.: 09/744,127

(22) PCT Filed: Jul. 16, 1999

(86) PCT No.: PCT/GB99/02148

§ 371 (c)(1),
(2), (4) Date: Jan. 19, 2001

(87) PCT Pub. No.: WO00/05457

PCT Pub. Date: Feb. 3, 2000

(30) Foreign Application Priority Data

Jul. 21, 1998 (GB) ..... 9815711

(51) Int. Cl.[7] ..... E01F 15/00; E01F 13/00

(52) U.S. Cl. ..... 256/13.1; 404/9; 404/10; 49/49

(58) Field of Search ..... 256/13.1; 404/6, 404/9, 10; 49/34, 49; 116/63 R

(56) References Cited

U.S. PATENT DOCUMENTS 3,332,666 A * 7/1967 Gray ..... 256/13.1
3,385,564 A * 5/1968 Persicke ..... 256/13.1
3,709,112 A 1/1973 Ebinger
3,925,929 A * 12/1975 Montgomery ..... 403/2
3,963,218 A 6/1976 Glaesener
3,968,596 A 7/1976 Danin
4,078,867 A * 3/1978 Ronden ..... 404/10
4,123,183 A * 10/1978 Ryan ..... 256/1
4,190,379 A * 2/1980 Toro Sosa et al. ..... 404/6
4,353,665 A 10/1982 Green
4,511,281 A 4/1985 Schmanski
4,535,974 A 8/1985 Conde
4,641,459 A * 2/1987 Mesa ..... 256/1
4,705,426 A * 11/1987 Perea ..... 404/6
4,822,206 A * 4/1989 Roussel et al. ..... 404/10
4,844,653 A * 7/1989 Dickinson ..... 404/6
4,875,797 A * 10/1989 Hartwig ..... 404/6
4,901,071 A * 2/1990 Fletcher ..... 340/665
4,934,097 A * 6/1990 Quante ..... 404/6
5,146,710 A * 9/1992 Caldwell ..... 404/6
5,167,093 A * 12/1992 Hamilton ..... 404/6
5,228,237 A * 7/1993 Nasatka ..... 404/6
5,309,674 A * 5/1994 Weibel ..... 404/10
5,474,016 A 12/1995 Haney
6,150,958 A * 11/2000 Worsham ..... 340/932.2
6,155,744 A * 12/2000 Namanny ..... 256/1

FOREIGN PATENT DOCUMENTS

GB 2202564 A 9/1988

* cited by examiner

*Primary Examiner*—Gary S. Hartmann
(74) *Attorney, Agent, or Firm*—Fay, Sharpe, Fagan, Minnich & McKee, LLP

(57) ABSTRACT

A guide device for guiding drivers and their vehicles into and out of vehicle parking spaces. The guide device comprises an operating arm, which is attached to a surface by two brackets, namely an outer bracket and an inner bracket. A cam plinth is situated between the two brackets. The guide device is arranged such that the arm can pivot relative to the brackets.

30 Claims, 5 Drawing Sheets

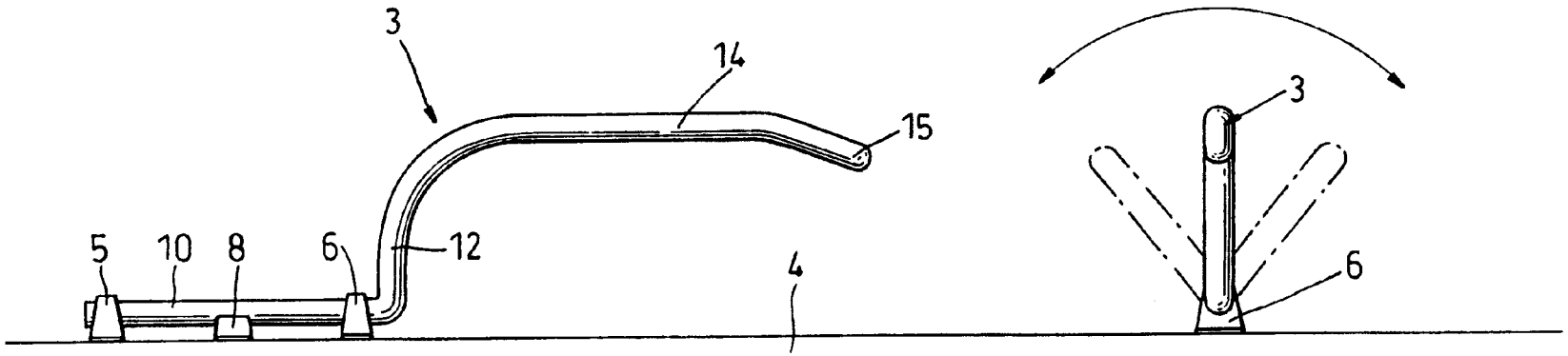
Fig. 2
Fig. 3
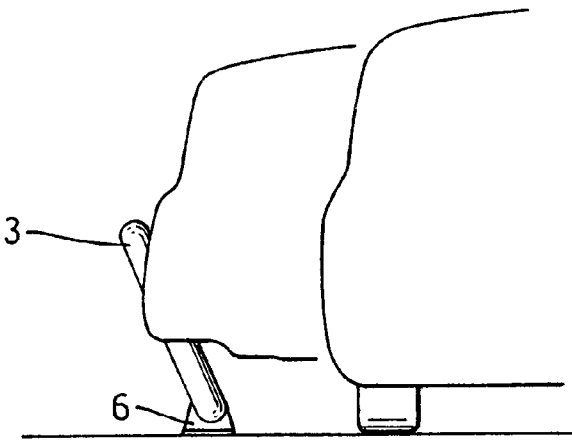
Fig. 4

GUIDE DEVICE FOR VEHICLE PARKING

This application claims priority from international application no. PCT/GB99/02148 having an international filing date of Jul. 16 1999, which claims priority from British application no. 9815711.8 filed Jul. 21 1998.

BACKGROUND OF THE INVENTION

The present invention relates to a guide device. In particular, but not exclusively, the invention relates to a guide device for guiding drivers and their vehicles into and out of parking spaces while protecting vehicles from impact.

In public and private car parks, the dimensions of designated parking spaces are calculated such that each parking space is wide enough for the parking of a "standard" vehicle, and allows adequate space between adjacent parked vehicles for the occupants to get out of and into the vehicles with an assumption of relative ease. The width is calculated on the assumption that all drivers park their vehicles nearly centrally within the designated parking space.

Conventional markings on the ground of parking spaces are generally not visible during a parking manoeuvre and as a result, most drivers will seek to park at around the midpoint between the two adjacent vehicles. It is well known that not all drivers are neat parkers, and any inaccuracies in the position of a row of parked vehicles are thereby perpetuated and maintained as vehicles join or depart from the row of parked vehicles concerned. For example, once a driver has located a vacant parking space in a car park, he/she is often faced with the situation that the vehicles in the two adjacent parking spaces have not parked straight and/or in the centre of their respective spaces, thereby reducing the amount of space available to the driver on parking. A number of problems arise, the most obvious being that there will be insufficient room for the occupants to get out of the vehicle. Due to poor parking or mere carelessness, vehicles are often damaged as a result of the opening of doors of adjacent vehicles, or by the manoeuvring of shopping trolleys or prams between the parked vehicles. Vehicles can also be damaged along their flanks by collision while a vehicle exits or enters a car parking space.

U.S. Pat. No. 4,535,974 describes a barrier or guard rail that is designed to be installed between vehicle parking spaces. It includes a cushioned impact absorbing surface that is supported above the ground by a set of equally spaced posts.

It is the aim of the present invention to provide a guide device that mitigates at least some of the above-mentioned problems, inducing greater care on the part of manoeuvring drivers and increasing the safety, convenience and efficiency of vehicle parking.

SUMMARY OF THE INVENTION

According to the present invention, there is provided a guide device for guiding drivers and their vehicles accurately into and out of vehicle parking spaces and protecting vehicles from impact, characterised in that said device includes an elongate cantilever arm, a support member connected to the arm towards one end thereof for supporting the arm above the ground and a pivoting mechanism connected to the support member that allows the support member and the arm to pivot about an axis that is, in use, substantially horizontal and in the same vertical plane as the arm.

The present invention encourages drivers to park their vehicles in parking spaces more accurately, so that they are parked near the centre and nearly straight. The guide device is positioned above the ground, within the driver's line of sight, thereby providing visual and physical guidance to drivers engaged in manoeuvring into or out of a parking space. As vehicles are parked more accurately, there is a potential for smaller vehicle bays to be defined by guide devices, in situations where it is desirable to favour use by smaller vehicles. The increased accuracy of parking manoeuvres into and out of vehicle bays also permits the use of narrower than usual access lanes, while encouraging generally more care on the part of drivers. The device protects the flanks, or front and rear of both the vehicle concerned and its neighbours from impact. The device also protects a vehicle against damage from carelessly opened doors of adjacent vehicles, and makes it difficult for shopping trolleys and prams to be pushed between parked vehicles.

Advantageously, the guide device includes a base structure for attaching the device to the ground.

Advantageously, the pivoting mechanism includes a biassing means for biassing the support member to a substantially upright position Said biassing means maybe arranged to provide bias over a predetermined range of movement between parked vehicles, and no bias if movement exceeds the predetermined range, such that the device will release and lie flat if the predetermined range is exceeded. Preferably, the predetermined range includes displacements up to an angle of approximately 40° either side of the vertical corresponding to the effective gap between vehicles, although other ranges may be suitable. The biassing means may include a means for restraining the support member in a substantially upright position after being deflected.

Advantageously, the elongate arm is arranged to be substantially horizontal in use.

Preferably the elongate arm is flexible, relatively smooth and soft. The elongate arm is thus benign and yielding upon impact with any part of a vehicle, pedestrians, or other moving objects.

Advantageously, the elongate arm has a visually prominent end feature preferably made of a brightly coloured plastics material. Preferably, the plastics material is high density polyethelene.

Advantageously, the free end of the elongate arm is deflected downward.

Preferably the base structure includes at least one bracket means and a base member that engages said bracket means and is rotatable relative to it.

Preferably the base member, support member and elongate arm of the guide device comprise a single elongate element including a base portion, a support portion and an arm portion.

Thus this guide device consists of only five components, with only one mechanically moving part. All of the components are extremely robust, require nil maintenance over a long period, and are difficult to vandalise. The device can be assembled on site, and no specialised skills are required for installation.

Advantageously, the elongate element comprises a substantially cylindrical tube. Preferably said tube is substantially Z-shaped or C-shaped.

Advantageously said biassing means engages said base portion Preferably, the biassing means causes resilient deformation of the base portion when the support portion is deflected from a substantially upright position. For example the biassing means may include a means for engaging a circumferential part of the base portion to restrict rotational movement between said engaging means and said circumferential part such that when the support member is deflected, the base portion is deformed laterally. The engaging means may include at least one lug for engaging a corresponding hole in said base portion. Preferably, the engaging means includes two lugs for engaging corresponding holes in the base portion, with said lugs being inclined towards one another.

The said biassing means is preferably located between two bracket means. The biassing means and the bracket means may be incorporated into a single integrated fabrication.

Advantageously said biassing means has a concave bearing surface, which includes a detent means for restraining said support portion in a substantially upright position.

Advantageously said biassing means and said bracket means are durable metal castings or durable and low friction plastics mouldings, and said elongate element may be manufactured from a low friction, high density polymer, in hollow section, preferably polyethylene. The elongate element may be of large radius and is preferably flexible. Advantageously said elongate element is either partially or totally filled with a semi-rigid foam filling.

Advantageously said support portion includes a damping means for damping oscillations of the elongate arm and support member.

The present invention further provides a car park having a plurality of car parking spaces in which vehicles may be parked, and a plurality of guide devices located between adjacent car parking spaces to delimit the boundaries of those spaces and to guide vehicles into and out of the spaces, characterised in that each said guide device includes an elongate cantilever arm, a support member connected to the arm towards one end thereof for supporting the arm above the ground and a pivoting mechanism connected to the support member that allows the support member and the arm to pivot about an axis that is, in use, substantially horizontal and in the same vertical plane as the arm.

BRIEF DESCRIPTION OF THE DRAWINGS

Embodiments of the invention will now be described, by way of example, with reference to the accompanying drawings, of which:

FIG. 2 is a side view of the Z-shaped guide device;

FIG. 3 is a front view of the Z-shaped guide device, showing the movement of the operating arm to either side of the vertical;

FIG. 4 is a front view showing the movement of the operating arm moving aside on opening a vehicle door;

DETAILED DESCRIPTION OF PREFERRED EMBODIMENTS

Figure 1A:
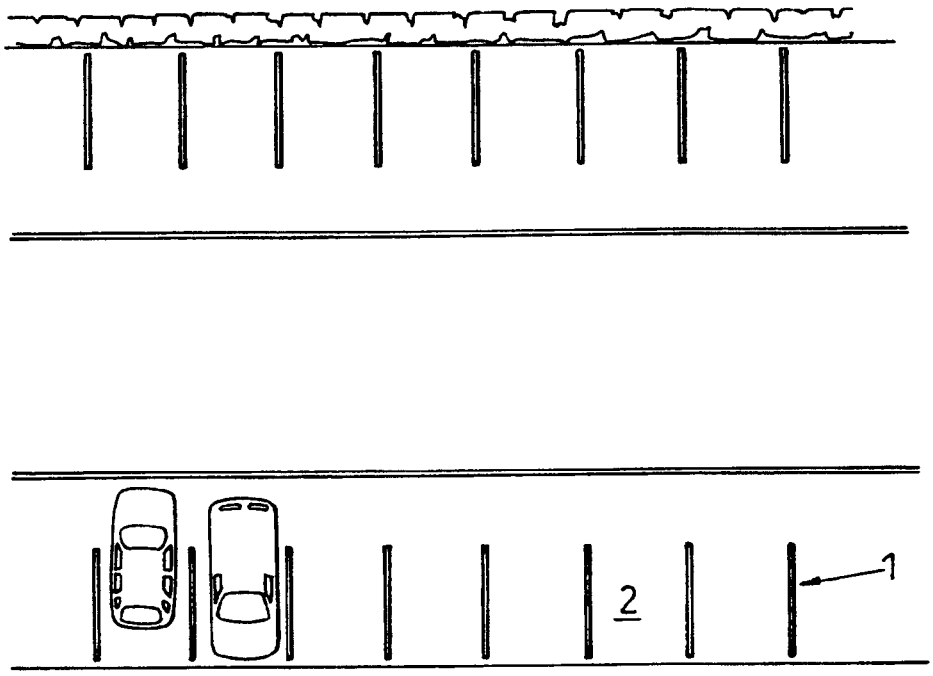
FIG. 1 is a plan view of a typical car park, illustrating the positions of the guide devices.
Figure 1B:
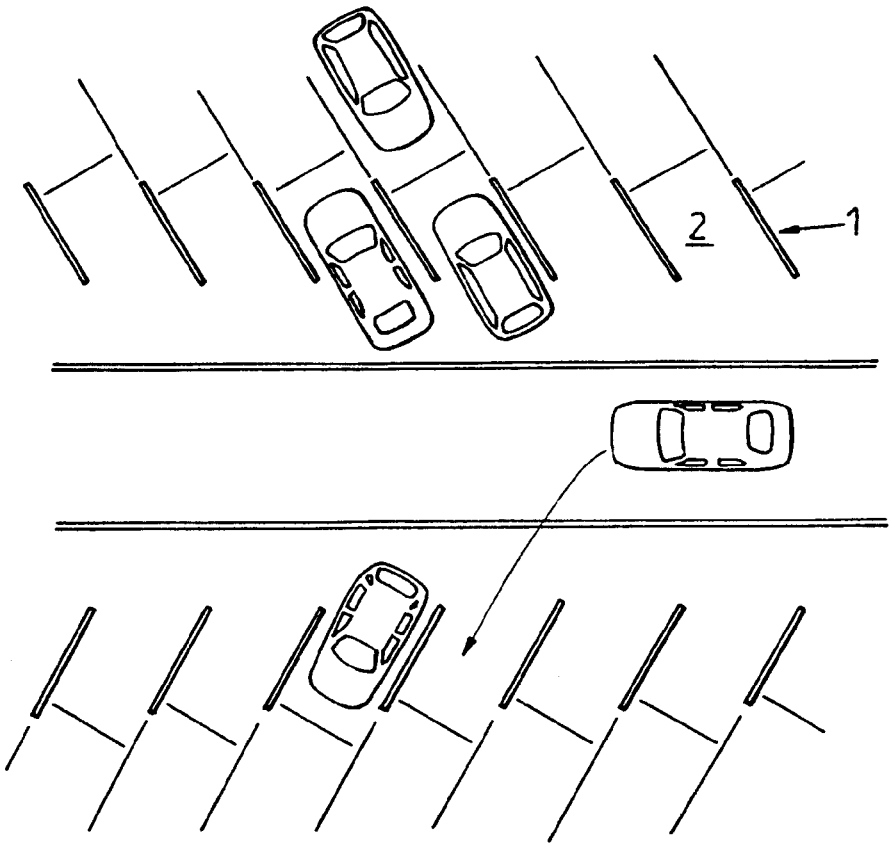

One embodiment of the guide device is a Z-shaped guide device 1. FIGS. 1*a* and 1*b* show the use of the guide device 1 in two different parking arrangements. In FIG. 1*a* the parking spaces are perpendicular to the access lane, and in FIG. 1*b* they are at an angle, of approximately 60° to the access lane. In a perpendicular arrangement, the guide device 1 delimits the width of each parking space 2 within a designated parking area. The distance between adjacent guide devices is normally 2400 mm, and the length of the guide device is such that once installed, the loading area for trolleys and prams at the front of the parking space is retained and remains unobstructed for normal use. The device 1 is bolted to the ground at the rear of the parking space 2. The guide device may also be used to delimit the width of each parking space in more space efficient "chevron" or, "herringbone" parking layout, as shown in FIG. 1*b*.

The guide device is shown in FIGS. 2 and 3 and consists essentially of an operating arm 3, which is attached to the ground 4 by two identical brackets, namely an outer bracket 5 and an inner bracket 6, with a cam plinth 8 situated half way between the two brackets 5, 6.

The operating arm 3 consists of a 90 mm diameter tube, preferably of a low friction, high density plastic, for example polyethylene.

The operating arm 3 has three sections. The lower section (or base portion) 10 is horizontal, and remains at ground level. The middle section (or support portion) 12 is substantially upright and has a right-angle joint at the lower end where it is attached to the base portion, and a 90° curve at the upper end, which extends substantially horizontally to form the upper section (or arm portion) 14. The free end 15 of the arm portion 14 is curved downward, and therefore back towards the user's own vehicle when a vehicle door deflects the arm and support portion away from their vertical alignment. At the free end of the arm portion 14 is a rounded end feature, which is brightly coloured and may bell made of a low friction plastics material for example polyethelene.

The operating arm 3 is positioned at a height of approximately 800 mm above the ground. At this height the operating arm will not interfere with the side mirrors or other projections along the flank of manoeuvring vehicles.

Figure 5:
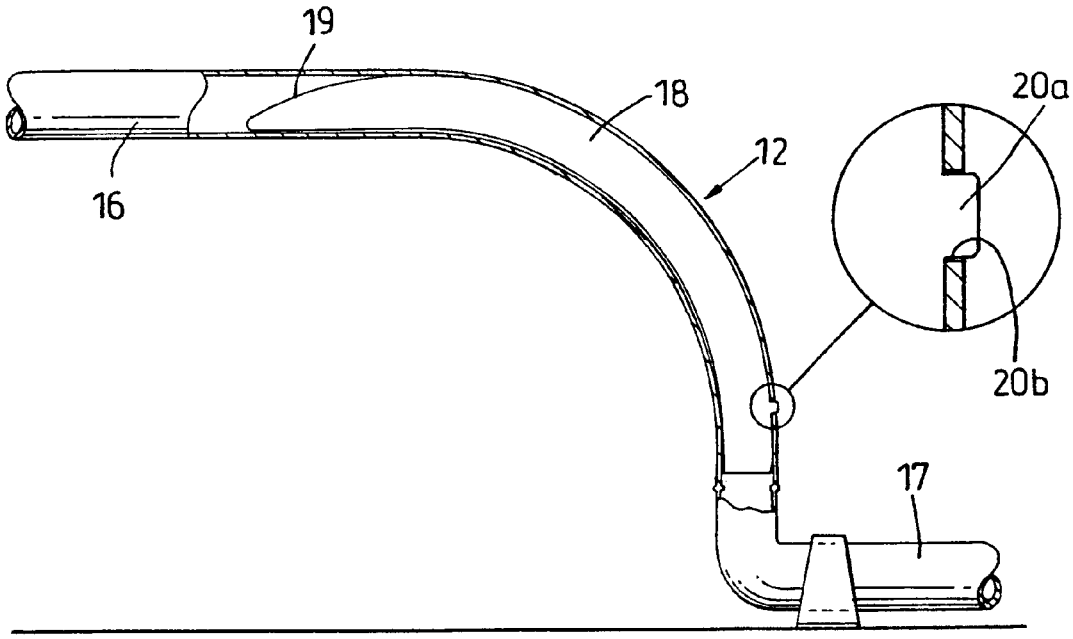
FIG. 5 is a sectional side view of part of a Z-shaped guide device, showing the inclusion of a damping web in the operating arm.

The support portion 12 is formed by welding an upper bend 16 onto an elbow 17, as shown in FIG. 5. In order to maintain the desired 90° curve at the upper end of the support portion 12, a damping web 18 may be provided.

If a damping web is to be used, the upper bend 16 is heated and pulled to an angle of around 85°. While the polyethylene is warm and semi-plastic a damping web 18 is inserted into the tube from its lower end to force the upper bend of the operating arm to bend at the desired 90°.

Preferably the damping web 18 is made from polyethylene sheet, approximately 10 mm thick. The damping web 18 is formed to the precise sickle shape required to constrain the tube in a downward direction, thereby preventing subsequent droop in the operating arm. Due to the shape of the damping web 18, it will also damp out vertical resonance when the operating arm is caused to move upward or downward. Upon downward movement of the operating arm, the toe 19 of the damping web 18 will cease its pressure on the inner face of the operating arm. As the operating arm rebounds in an upward direction the toe 19 re-engages with the inner face, preventing the operating arm from rebounding above its original height.

The damping web 18 is secured within the operating arm by means of a lug 20*a* on the outer edge of the damping web and a hole 20*b* located on the outer face of the pulled bend, which aligns and secures the web in the position where the bend will have assumed its final angle of 90°. Once the pulled bend 16 has cooled, the lower end of the tube can be trimmed and fused to the elbow joint 17. The lower end of the damping web 18 is above the position of the weld between the upper bend 16 and the elbow 17.

The operating arm 3 may have all or part of its hollow tube injected with semi-rigid foam in the interests of stiffening and/or improving the elastometric performance of the various parts.

Figure 6:
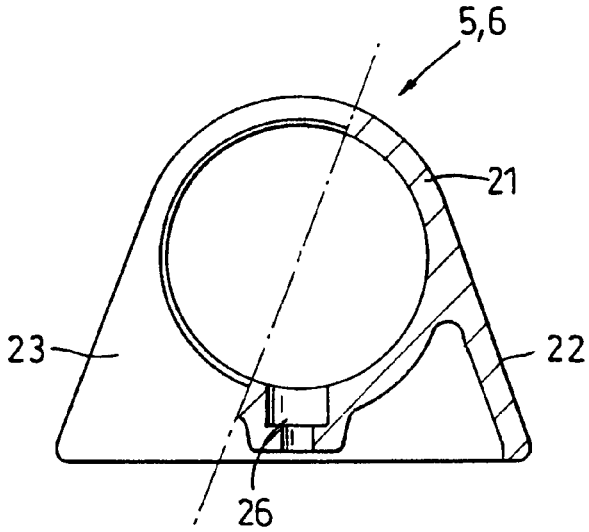
FIG. 6 is an end view of a bracket, partly in cross-section.
Figure 7:
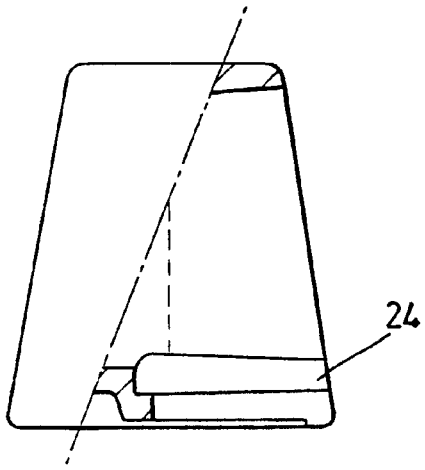
FIG. 7 is a side view of the bracket, partly in cross-section.

The operating arm 3 is held in position by two identical brackets 5, 6, shown in FIGS. 6 and 7. The brackets provide fixed mountings for securing the guide device to the ground beneath. Each bracket is a casting consisting of a cylindrical bearing 21 with a 91 mm internal diameter. The diameter is large enough to fit the tube of the operating arm 3, and allow for flexing and rotation about the longitudinal axis of the base portion 10. This enables swinging movement of the operating arm 3 to either side of the vertical, as shown in FIG. 3. The bearing 21 is supported by two inclined side walls 22, and two end walls 23. A slot 24 having an enlarged upper portion 26 is provided in the lower face the bracket and extends from one end of the bracket approximately to its centre. The slot 24 is designed to receive a rag bolt for securing the bracket into the ground beneath.

Figure 8:
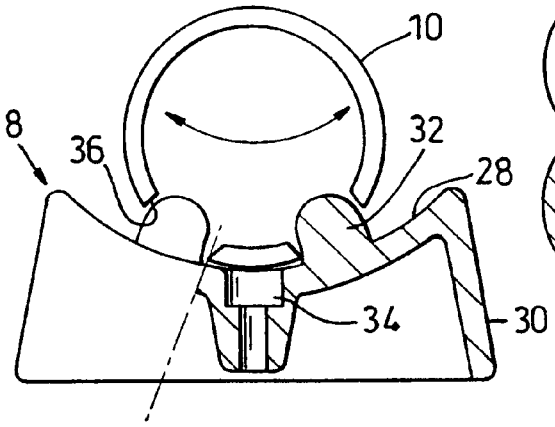
FIG. 8 is an end view of a cam plinth, partly in cross-section.
Figure 9:
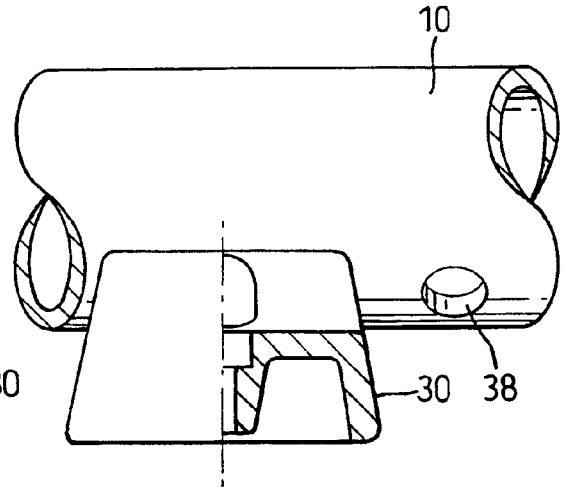
FIG. 9 is a side view of the cam plinth, partly in cross-section.
Figure 10:
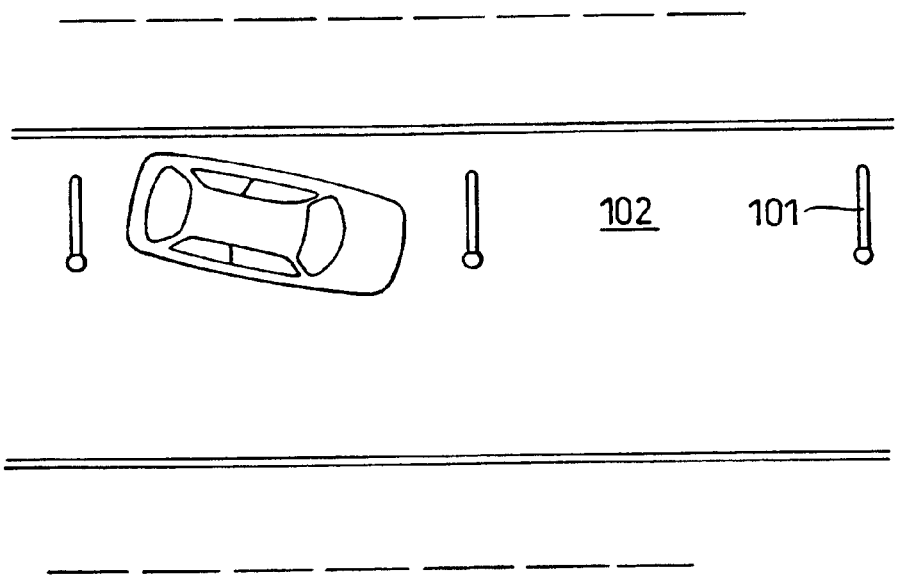
FIG. 10 is a plan view of typical parking arrangement alongside a kerb, illustrating the position of a guide device.
Figure 11:
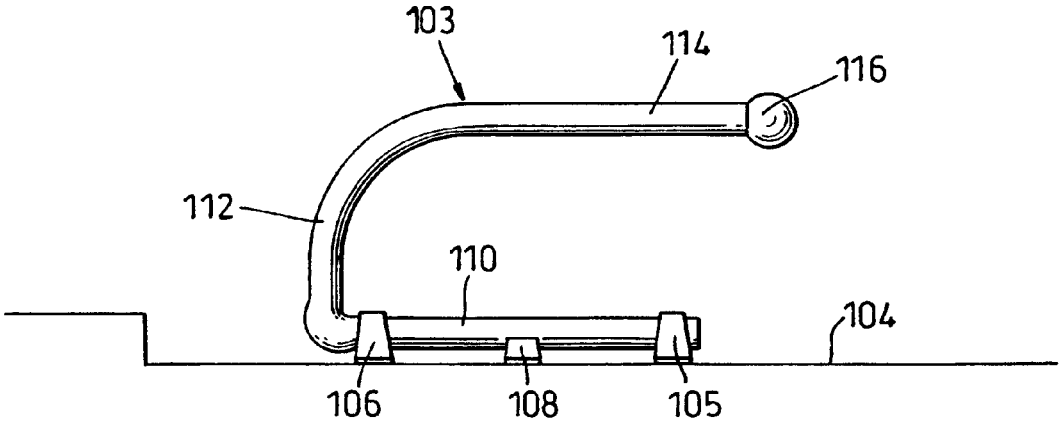
FIG. 11 is a side view of the C-shaped guide device.

The cam plinth 8 is situated midway between the two brackets 5, 6. It provides a pivoting mechanism and maintains the equilibrium position of the operating arm in the vertical position. The cam plinth, which is shown in FIGS. 8 and 9, has a concave cylindrical, upper bearing surface 28 which is supported by four inclined walls 30. Two rounded locating lugs 32 protrude upwards from the bearing surface 28. The lugs 32 are inclined; inwards, at approximately 40° to the vertical, and are curved slightly inwards. A recessed bolt hole 34 is provided in the lower surface of the cam plinth, allowing it to be fixed to the surface of the car park with a rag bolt.

Two sets of holes 36, 38 are provided on the underside of the base portion 10 of the operating arm. Each set of holes consists of two holes that are drilled into the lower surface of the operating arm at approximately 40° either side of vertical. The first set of holes 36 is situated 520 mm from the end of the arm, and the second set of holes 38 is drilled into the operating arm 100 mm further along the arm towards the elbow bend 17.

The two lugs 32, which are slightly smaller than the holes 36, 38 drilled into the base portion 10 of the operating arm, engage in the holes and cause the base portion 10 to roll away from its central position as it rotates. As the two ends of the base portion 10 are restrained by the brackets 5, 6, a bend is produced in the base portion 10, which is opposed owing to the resilience of the plastics tube. This produces a biassing force that biasses the operating arm towards the vertical position.

The operation of the guide device will now be described. In the rest position the guide device is in a vertical position and it is retained in this position by the operation of the cam plinth 8 and the resilience of the base portion 10. The operating arm of the guide device may be pushed to either side of the vertical, but on release it will return gently to the original vertical position.

This mechanism can be explained as follows, as the arm rotates, the lugs on the cam plinth engage in the holes in the lower section of the operating arm, causing the section between the brackets 5, 6 to flex sideways and upwards. Upon release, the lateral flex imparted to the section between the brackets returns the lower arm to its original position, thereby restoring the support portion 12 of the arm to its original vertical position. The geometry of the lugs is calculated to allow free movement over the normal operating arc of around. 40° from the vertical. If the arm is forced beyond that arc then the geometry of the lugs, will initially resist further movement, before the tube overrides the lugs, allowing the upper section to lie flat on the ground. The operating arm can later be lifted back into the vertical position, whereupon the lugs 32 will re-engage the holes 36, 38, without detriment to the operation of the device.

On installation the cam lugs 32 are engaged with the first pair of holes 36 drilled into the base portion 10 of the operating arm. After extensive wear on the first pair of holes 36, the operating arm can be repositioned so that the cam lugs 32 will engage in the second pair of holes 38, thereby extending the life of the operating arm. This will not affect the functioning of the guide device. In the case of extreme wear the entire arm can easily be replaced.

The guide device 1 is fastened to the ground at the rear of the parking space, so as not to provide any foot impediment to the occupants of a vehicle when getting into or out of the vehicle. To reduce the possibility of a pedestrian tripping over the lower section of the operating arm, the brackets 5, 6 and the cam plinth 8 are finished with a bright colour for good visibility.

Once a vehicle has been parked, the guide device 1 will allow shared use of the space between vehicles and will also protect the vehicle from being damaged by those adjacent to it. When a vehicle door is opened, as shown in FIG. 4, it makes contact with the horizontal arm portion, which may then move sideways until it comes into contact with an adjacent vehicle. If so, then this provides a cushioning effect between the vehicles, thereby preventing damage. On closure of the door, the horizontal arm will return to its original vertical position.

The downward deflection of the free end 15 of the arm portion 14 of the operating arm results in the operating arm being inclined back towards to door opening vehicle, encouraging less frequent contact between adjacent vehicles, and permits the vehicle doors to be generally opened further without any such contact. Another advantage of the downward deflection of the free end 15 is that if the operating arm is bent downward, for example by children playing, less energy can be imparted causing it to rebound upward in a less threatening manner, and to a lower height.

The position of the guide device also prevents damage to the flanks of motor vehicles by preventing the manoeuvring of shopping trolleys and prams between parked vehicles.

Due to the increased accuracy of parking by drivers into and out of parking bays, the width of the access lanes to the parking spaces could be reduced. This will increase the potential capacity of a parking area.

Another embodiment of the guide device is a C-shaped guide device 101. The guide device delimits the length of each parking space 102 alongside a kerb, or otherwise parallel about its long axis with an adjacent carriageway, as shown in FIGS. 1-2. The guide device can be installed at conventional spacing on or alongside a carriageway.

The guide device is shown in FIG. 13 and consists essentially of an operating arm 103, which is attached to the ground 104 by two identical brackets, namely an outer bracket 105 and an inner bracket 106, with a cam plinth 108 situated half way between the two brackets 105,106.

The operating arm 103 consists of a 90 mm diameter tube, preferably of a low friction, high density plastic, for example polyethylene.

The operating arm 103 has three sections. The lower section (or base portion) 110 is horizontal and remains at ground level. The middle section (or support portion) 112 is substantially upright and has a right angled joint at the lower end where it is attached to the base portion, and a 90° curve at the upper end, which then extends substantially horizontally to form the upper section (or arm portion) 114. The arm portion is raised approximately 800 mm above the ground. The end of the arm portion 114 has an end feature, a ball 116. The end feature is preferably brightly coloured and made of a low friction plastics material for example a high density polyethelene.

The operating arm 103 may have all or part of its hollow fabric injected with semi-rigid foam in the interests of stiffening and/or improving the elastometric performance of the various parts. Alternatively or in addition, the operating arm 103 may incorporate a damping web within its upper bend, as described above.

The base portion 110, identical brackets 105,106 and cam plinth 108 have the same, features as described above for the Z-shaped guide device, enabling the guide device 101 to operate by means of a similar mechanism.

The guide device 101 is fastened to the ground some 500 m from the edge of the carriageway used for designated parking, to facilitate cleansing of any adjacent gully by brush or similar means. In this position its rounded upper face is also placed at a safe distance from passing pedestrians on any adjacent footway.

The support portion 112 is positioned some 1500 mm from the unobstructed carriageway adjoining the designated parking space. At this distance it does not interfere with the extremities of a vehicle pivoting into or out of that parking space, but it will intervene as a buffer between adjacent vehicles, clear of a centrally mounted registration plate, if the vehicle being parked is subsequently manoeuvring in a forward or rearward direction. Thus the guide device protects the vehicle and its immediate neighbours from impact at their front and rear. If projecting beyond the flank of a parked vehicle, the end feature of the guide device will protect the flank of that vehicle from impact imparted by wayward vehicles passing along the adjacent carriageway.

The guide device can be installed at conventional spacing on or alongside the carriageway concerned, generally some 6 metres, or can be positioned to designate parking bays which are shorter than normally observed, if smaller vehicles are to be favoured at the locality or within the jurisdiction affected. This will either increase the number of designated parking bays available for use, or create space for enlarged footways, street planting or other environmental enhancements without net loss in the number of parking spaces made available.

Should a vehicle come into contact with the guide device 1,101 while manoeuvring into a parking space, its operating height is calculated to allow the arm portion 14, 114 to override the front or rear of the vehicle. The components of the guide device that make contact with the vehicle, namely the operating arm and its end feature 116 are made of a large radius polymeric material, which minimises the friction and force exerted on the vehicle. Should the vehicle continue to be driven through initial contact with the guide device, then the shape of the device and its inherent upward flex when at rest will cause it to ride upward over the vehicle's bodywork without exerting a large force to the bodywork, into the driver's line of vision, thereby alerting the driver to his misjudgment.

The guide device is designed to be resistant to vandalism All of the metal components (the brackets 5, 6, 105, 106 and the cam plinth 8, 108) are robust and not vulnerable to cutting, heating or impact. The device is fastened to the ground by substantial rag bolts using a specialised ratchet spanner. The operating arm is a thick walled tube of a high density polymer (for example high density polyethylene), which is resistant to sharp cutting blades and is a poor heat conductor. If the operating arm were forced off the cam and lugs, it can easily be refitted without damage.

A possible additional feature to the parking aid is the attachment of a cap on to the end of the base portion 10, 110 of the operating arm, to prevent unauthorised access to the securing rag bolt. The operating arm could also be pulled out of the brackets, once the holes in the operating arm are disengaged from the lugs in the cam plinth, and the addition of an end cap of larger diameter would also prevent this from happening.

There is also the potential for providing advertising material on, or attached to the device.

Various modifications of the guide device are envisaged, some of which are described: below.

The recessed bolt hole in the lower surface of the cam plinth could be replaced by a slot. The provision of a slot is preferable since the lower section of the operating arm will then sit on the edges of the slot, which will stabilise it in the vertical position and reduce waving of the operating arm in strong winds.

The main potential for wear on the guide device is at the two holes which interact with the lugs on the cam plinth. This wear may be significantly reduced by the insertion of a ferrule of Nylon or similar low friction material as the wearing surface.

The two brackets and cam plinth may be incorporated into a single integrated plinth fabricated from reinforced concrete, other composite material, or polymer plastic. This ensures that the two brackets and cam plinth will always be in the correct alignment regardless of any irregularities in the ground surface, allowing the guide device to be positioned on unsurfaced and unfirm ground, makeshift or temporary parking areas, or unlevel ground. The integrated plinth can be attached to the ground beneath using less than the three separate ground fittings.

The damping web 18 may be fabricated from soft sheet metal, rendering the guide device almost impossible to vandalize.

Another modification to the guide device could be the attachment of a locking or user specific pivoting arm feature to the operating arm, for obstructing all or part of the affected parking space. This may be used to prevent unauthorised parking within the affected parking space, thereby reserving its use for authorised or user specific purposes.

The guide device may be adapted to detect unauthorised movement of a parked vehicle. This can be achieved by a modification of the operating arm, brackets or cam plinth to incorporate sensors and/or logic systems, relying on magnetic flux or the emission and/or reception of electromagnetic radiation, for the purpose of sensing movement of an adjacent vehicle, and subsequently activating an alarm function.

Alternatively, if the guide device is to be used in an enclosed car park, such as an underground car park or a multi-story car park, it may be mounted upside-down with the bracket means and other components attached to the overhead surface, so that the elongate arm is suspended between adjacent car park spaces.

What is claimed is:

1. A guide device for guiding drivers and their vehicles accurately into and out of vehicle parking spaces and protecting vehicles from impact, said device comprising:

an elongate cantilever arm, a support member connected to the arm towards one end thereof for supporting the arm, a pivoting mechanism connected to the support member that allows the support member and the arm to pivot about an axis that is, in use, substantially horizontal, and a base structure for attaching the device to a surface, wherein said pivoting mechanism includes a biassing means for biassing the support member to a substantially upright position that is arranged to provide bias over a predetermined range of movement, and no bias if movement exceeds the predetermined range, wherein said predetermined range comprises angular displacements of up to ±40° from the vertical.

2. A guide device according to claim 1, wherein said biassing means includes means for restraining the support member in a substantially upright position.

3. A guide device according to claim 1, wherein said elongate arm is arranged to be substantially horizontal in use.

4. A guide device according to claim 1, wherein said elongate arm has a visually prominent end feature.

5. A guide device according to claim 1, wherein said end feature is made of a brightly coloured plastics material.

6. A guide device according to claim 5, wherein said plastics material is a high density polyethylene.

7. A guide device according to claim 1, wherein said elongate arm has a free end that is deflected downwards.

8. A guide device according to claim 1, wherein said guide device is located between adjacent car parking spaces of a car park and delimits boundaries of said parking spaces and guides vehicles into and out of said parking spaces.

9. A guide device for guiding drivers and their vehicles accurately into and out of vehicle parking spaces and protecting vehicles from impact, said device comprising:

an elongate cantilever arm, a support member connected to the arm towards one end thereof for supporting the arm, a pivoting mechanism connected to the support member that allows the support member and the arm to pivot about an axis that is, in use, substantially horizontal, wherein said pivoting mechanism includes a biassing means for biassing the support member to a substantially upright position, and a base structure for attaching the device to a surface, the base structure comprising at least one bracket and a base member that engages said bracket and is rotatable relative to said bracket, wherein said base member, support member and elongate arm comprise an elongate element including a base portion, a support portion and an arm portion, said biassing means engages said base portion and wherein said biassing means causes resilient deformation of the base portion when the support portion is deflected from a substantially upright position.

10. A guide device according to claim 9, wherein said elongate element comprises a substantially cylindrical tube.

11. A guide device according to claim 9, wherein said elongate element is substantially Z-shaped.

12. A guide device according to claim 9, wherein said elongate element is substantially C-shaped.

13. A guide device according to claim 9, wherein said biassing means has a concave bearing surface.

14. A guide device according to claim 13, wherein said bearing surface includes a means for restraining said support portion and said arm portion in a substantially upright position.

15. A guide device according to claim 9, wherein said biassing means and said bracket are durable metal castings.

16. A guide device according to claim 9, wherein said biassing means and said bracket are durable and low friction plastics mouldings.

17. A guide device according to claim 9, wherein said elongate element is manufactured from a low friction, high density polymer, in hollow section.

18. A guide device according to claim 17, wherein said elongate element is manufactured from polyethylene.

19. A guide device according to claim 17, wherein said elongate element includes a semi-rigid foam filling.

20. A guide device according to claim 9, wherein said guide device is located between adjacent car parking spaces of a car park and delimits boundaries of said parking spaces and guides vehicles into and out of said parking spaces.

21. A guide device for guiding drivers and their vehicles accurately into and out of vehicle parking spaces and protecting vehicles from impact, said device comprising:

an elongate cantilever arm, a support member connected to the arm towards one end thereof for supporting the arm, a pivoting mechanism connected to the support member that allows the support member and the arm to pivot about an axis that is, in use, substantially horizontal, wherein said pivoting mechanism includes a biassing means for biassing the support member to a substantially upright position, and a base structure for attaching the device to a surface comprising at least one bracket and a base member that engages said bracket and is rotatable relative to said bracket, wherein said base member, support member and elongate arm comprise an elongate element including a base portion, a support portion and an arm portion, said biassing means engages said base portion and wherein said biassing means includes means for engaging a circumferential part of said base portion to restrict rotational movement between said engaging means and said circumferential part.

22. A guide device according to claim 21, wherein said engaging means includes at least one lug for engaging a corresponding hole in said base portion.

23. A guide device according to claim 22, wherein said engaging means includes two lugs for engaging corresponding holes in said base portion.

24. A guide device according to claim 23, wherein said lugs are inclined towards one another.

25. A guide device according to claim 21, wherein said biassing means is located between two brackets.

26. A guide device according to claim 21, wherein said biassing means and said bracket are incorporated into a single integrated fabrication.

27. A guide device according to claims 21, wherein said guide device is located between adjacent car parking spaces of a car park and delimits boundaries of said parking spaces and guides vehicles into and out of said parking spaces.

28. A guide device for guiding drivers and their vehicles accurately into and out of vehicle parking spaces and protecting vehicles from impact, said device comprising:

an elongate cantilever arm;

a support member connected to the arm towards one end thereof for supporting the arm, a pivoting mechanism connected to the support member that allows the support member and the arm to pivot about an axis that is, in use, substantially horizontal, wherein said pivoting mechanism includes a biassing means for biassing the support member to a substantially upright position, and a base structure for attaching the device to a surface comprising at least one bracket and a base member that engages said bracket and is rotatable relative to said bracket, wherein said base member, support member and elongate arm comprise an elongate element including a base portion, a support portion and an arm portion, and wherein said support portion includes a damping means for damping oscillations of said elongate arm and support member.

29. A guide device according to claim 28, wherein said guide device is located between adjacent car parking spaces of a car park and delimits boundaries of said parking spaces and guides vehicles into and out of said parking spaces.

30. A car park comprising:

a surface;

a plurality of parking spaces; and, a plurality of guide devices, said guide devices located respectively between a pair of adjacent parking spaces to delimit a boundary separating said pair of adjacent parking spaces from each other, each of said guide devices comprising a bracket secured to said surface and an elongate cantilever arm having a first portion pivotably secured to said bracket for angular movement about a pivot axis and a second portion spaced from said surface between said pair of parking spaces, said arm pivotable about said pivot axis in first and second directions.

* * * * *